US007402738B2

(12) United States Patent
Sawada et al.

(10) Patent No.: US 7,402,738 B2
(45) Date of Patent: Jul. 22, 2008

(54) WIND MUSICAL INSTRUMENT EQUIPPED WITH SLIDE AND SUPPORTING SYSTEM FOR ASSISTING PLAYER IN PERFORMANCE

(75) Inventors: Shuichi Sawada, Shizuoka-ken (JP); Hideo Suzuki, Shizuoka-ken (JP); Yoshinori Hayashi, Shizuoka-Ken (JP); Akihiko Komatsu, Shizuoka-Ken (JP); Nariyasu Yaguchi, Shizuoka-Ken (JP); Souichi Takigawa, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 11/688,671

(22) Filed: Mar. 20, 2007

(65) Prior Publication Data

US 2007/0221038 A1 Sep. 27, 2007

(30) Foreign Application Priority Data

Mar. 24, 2006 (JP) ..... 2006-084021

(51) Int. Cl.
*G10D 7/10* (2006.01)

(52) U.S. Cl. ..... 84/380 R; 84/93; 84/391; 84/395; 84/396; 84/649; 84/670

(58) Field of Classification Search ..... 84/93, 84/391, 395, 396, 387 A, 387 R, 648–651, 84/666–670

See application file for complete search history.

(56) References Cited

U.S. PATENT DOCUMENTS

| | | | | | |
|---|---|---|---|---|---|
| 1,880,961 | A | * | 10/1932 | Kingsley | 84/395 |
| 4,981,457 | A | * | 1/1991 | Iimura et al. | 446/408 |
| 5,149,904 | A | * | 9/1992 | Kamiya et al. | 84/723 |
| 5,668,340 | A | * | 9/1997 | Hashizume et al. | 84/742 |

FOREIGN PATENT DOCUMENTS

| | | | | |
|---|---|---|---|---|
| JP | 03091800 | A | * | 4/1991 |
| JP | 10254437 | A | * | 9/1998 |
| JP | 2004-177828 | A | | 6/2004 |

* cited by examiner

*Primary Examiner*—Lincoln Donovan
*Assistant Examiner*—Christopher Uhlir
(74) *Attorney, Agent, or Firm*—Dickstein Shapiro LLP

(57) ABSTRACT

A player changes the pitch of tones produced through a trombone by controlling the breath and a slide, and the control of slide is not easy for children, handicapped persons and old players; a supporting system is combined with the trombone, and includes a manipulating board fitted to an appropriate portion of the trombone close to the slide, a driving mechanism connected to the slide and a controlling unit connected to the manipulating board and driving mechanism; when the player wishes to change the pitch of tones through the sliding motion of the slide, he moves a lever on the manipulating board by a distance shorter than a target stroke of the slide, and the controlling unit calculates the target stroke so as to supply a driving signal to the driving mechanism; and the driving mechanism exerts force on the slide so as to assist the player in varying the length of the column of air.

20 Claims, 4 Drawing Sheets

WIND MUSICAL INSTRUMENT EQUIPPED WITH SLIDE AND SUPPORTING SYSTEM FOR ASSISTING PLAYER IN PERFORMANCE

FIELD OF THE INVENTION

This invention relates to a wind musical instrument and, more particularly, to a wind musical instrument equipped with a slide and a supporting system combined with the wind musical instrument for assisting a player in performance.

DESCRIPTION OF THE RELATED ART

A trombone belongs to the wind musical instrument. Although some models of trombones have valves, trombones with slides are popular to music fans. The trombone has a pipe structure connected to a mouthpiece, and a slide forms a part of the pipe structure. The slide is constituted by an inner tube and an outer slide tube. The inner tube is continued to a tuning slide, which is another part of the pipe structure, and is inserted into the outer slide tube. When a player gets ready to play a music passage on the trombone, his or her lips are put on the mouthpiece, and the player buzzes on the mouthpiece. While the player is performing the music passage, he or she varies the pitch of tones by controlling the breath and sliding the outer slide tube by hand.

The faster the slide control is, the quicker the pitch change is. The longer the reach is, the wider the range is. In short, the trombone requires moving the slide fast and widely. Although adult players have strong arms and wide reach, it is not easy for children and handicapped persons quickly widely to slide the outer slide tube against the friction between the inner tube and outer slide tube. It is said that the slide takes seven positions. However, the reach of young children is too short to move the outer slide tube from the nearest slide position to the farthest slide position. This results in that the slide does not permit the young children to perform some sorts of music tunes, which vary the pitch of tones in a wide range. Thus, the children, handicapped persons and old players require assistance in their performance on the trombones.

An automatic playing system for a wind instrument is disclosed in Japan Patent Application laid-open No. 2004-177828. The automatic playing system includes an air compressor, an electromagnetic valve, artificial lips, solenoid-operated valve actuators and a controlling unit. The artificial lips are put on the mouthpiece, and the air compressor is connected to the artificial lips through the electromagnetic valve, and supplies the high-pressure air to the artificial lips. The artificial lips give rise to vibrations of the columns of air in the pipe structure, and the solenoid-operated valve actuators selectively push down the piston valves of the wind musical instrument under the control of the controlling unit. The length of the column of air is varied depending upon the valve actions. Thus, a music passage is performed on the wind musical instrument by the automatic playing system instead of a human player.

The automatic playing system is designed to perform music tunes on a wind musical instrument without any fingering and buzzing of a human player. In other words, the automatic playing system can not assist a player in performing a music tune on a wind musical instrument.

SUMMARY OF THE INVENTION

It is therefore an important object of the present invention to provide a wind musical instrument with a slide in which a supporting system is provided for assisting players in their performances.

It is also an important object of the present invention to provide a supporting system which makes a standard wind musical instrument with slide retrofitted to the wind musical instrument.

To accomplish the object, the present invention proposes mechanically to assist a player in varying the length of a column of air.

In accordance with one aspect of the present invention, there is provided a wind musical instrument for producing tones through breath of a human player comprising a pipe structure defining a column of air therein, permitting the human player to excite the column of air for vibrations and including a slide varying the length of the column of air through elongation and shrinkage thereof for changing the pitch of the tones, and a supporting system assisting the human player in changing the pitch of the tones and including a manipulating board having a manipulator moved by the human player so as to indicate a target length of the column of air and a signal generator producing a detecting signal representative of the target length, a driving mechanism connected to the slide and responsive to a driving signal so as to elongate and shrink the slide and a controller connected to the signal generator and the driving mechanism and supplying the driving signal to the driving mechanism so as to elongate and shrink the slide until the column of air becomes the target length.

In accordance with another aspect of the present invention, there is provided a supporting system combined with a wind instrument equipped with a slide for changing the pitch of tones produced through the wind instrument, and the supporting system comprises a manipulating board including a manipulator moved by the human player so as to indicate a target length of a column of air created in the wind instrument and a signal generator producing a detecting signal representative of the target length, a driving mechanism connected to the slide and responsive to a driving signal so as to elongate and shrink the slide and a controller connected to the signal generator and the driving mechanism and supplying the driving signal to the driving mechanism so as to elongate and shrink the slide until the column of air becomes the target length.

BRIEF DESCRIPTION OF THE DRAWINGS

The features and advantages of the wind musical instrument and supporting system will be more clearly understood from the following description taken in conjunction with the accompanying drawings, in which.

DESCRIPTION OF THE PREFERRED EMBODIMENTS

A human player produces tones through a wind musical instrument by controlling his or her breath and the length of a vibratory column of air. The wind musical instrument embodying the present invention largely comprises a pipe structure and a supporting system. The column of air is defined in the pipe structure, and the human player excites the column of air for vibrations by his or her breath.

A slide forms a part of the pipe structure, and is used to elongate and shrink the length of the column of air. The slide is to be moved against strong resistance. For this reason, the elongation and shrinkage of slide is not so easy for children, handicapped persons and old players. Moreover, the range of pitch is dependent on the stroke of the slide. Therefore, a player with a short reach suffers from a narrow range of pitch, and the narrow range of pitch sets a limit to music tunes performable by the player. These problems are solved by using the supporting system.

The supporting system includes a manipulating board, a driving mechanism and a controller. The controller is electrically connected to the manipulating board and driving mechanism.

The manipulating board has a manipulator and a signal generator. The human player moves the manipulator so as to indicate a target length of the column of air, and the signal generator produces a detecting signal representative of the target length. The detecting signal is supplied from the signal generator to the controller.

The driving mechanism is connected to the slide, and is responsive to a driving signal so as to elongate and shrink the slide. The controller analyzes the detecting signal so as to determine how long the slide is to be elongated or shrunk. Then, the controller produces the driving signal, and supplies the driving signal to the driving mechanism so as to elongate and shrink the slide until the column of air becomes the target length.

Thus, the driving mechanism exerts the force on the slide, and assists the human player in varying the length of the column of air. By virtue of the supporting system, children, handicapped persons and old players can lightly elongate and shrink the slide so as to perform a music tune on the wind musical instrument.

Even if a player has a short reach, the slide is moved over the full stroke by means of the driving mechanism. Thus, the supporting system makes it possible to widen the range of pitch, and permits the player to play a wide variety of music tunes on the wind musical instrument.

First Embodiment

Figure 1:
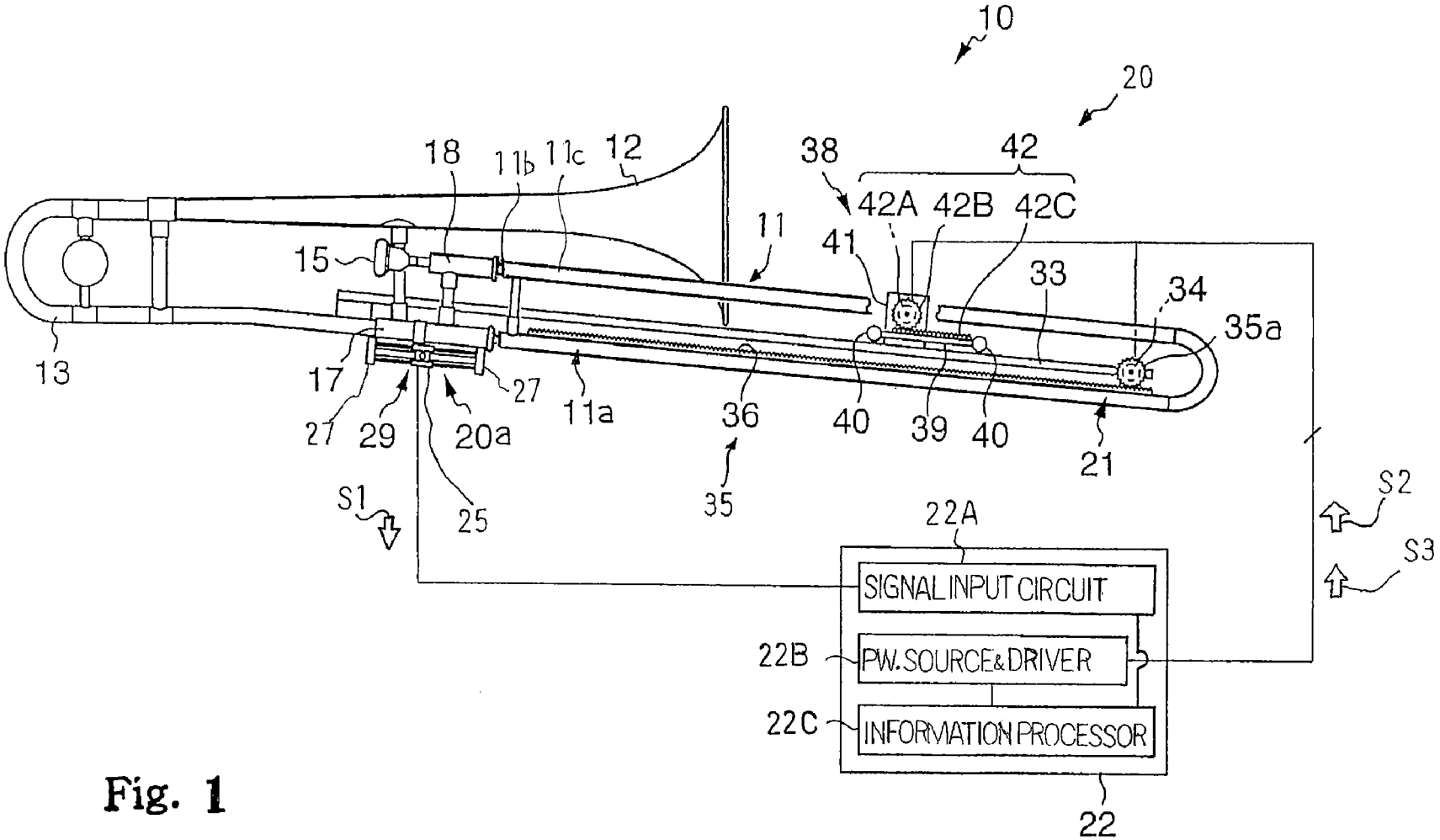
FIG. 1 is a partially cut-off schematic view showing the structure of a wind musical instrument according to the present invention.

Referring first to FIG. 1 of the drawings, a wind musical instrument embodying the present invention largely comprises a tenor trombone 10 and a supporting system 20. The tenor trombone 10 is a member of a brass instrument, which in turn belongs to the wind musical instrument. The supporting system 20 is combined with the standard trombone 10, and assists a human player in changing the pitch of tones.

The tenor trombone 10 largely comprises a pipe structure 11 and a mouthpiece 15. A column of air is defined in the pipe structure 11, and tones are produced through vibrations of the column of air. The mouthpiece 15 is connected to the pipe structure 11, and a player puts his or her lips on the mouthpiece 15 for buzzing. While the player is buzzing on the mouthpiece 15, the column of air vibrates, and tones are radiated from the trombone 10.

The pipe structure 11 includes a slide 11*a*, a bell 12, a tuning slide 13, a slide receiver 17 and a mouthpiece receiver 18. The mouthpiece receiver 18 is a short tube, and the mouthpiece 15 is inserted into the mouthpiece receiver 18. The slide receiver 17 is also a short tube, and is connected to the tuning slide 12, which in turn is connected to the bell 12. The slide 11*a* is folded, and, accordingly, has a U-letter shape. The slide 11*a* is connected at one end thereof to the mouthpiece receiver 18, and at the other end thereof to the slide receiver 17. The column of air is elongated by means of the slide 11*a*, and the pitch of tones is varied depending upon the length of column of air.

The slide 11*a* has an inner tube 11*b* and an outer slide tube 11*c*. Two straight tubes form the inner tube 11*b*, and are arranged in parallel to each other. On the other hand, a folded tube and a stay form the outer slide tube 11*c*, and the folded tube has two straight portions. The inner tube 11*b* is connected at both ends thereof to the mouthpiece receiver 18 and slide receiver 17, and is stationary to those receivers 17 and 18. The straight tubes of the inner tube 11*b* are inserted into the straight portions of the outer slide tube 11*c* so that the outer slide tube 11*c* is slidable on the inner tube 11*b*. When a player varies the pitch of tones by changing the slide position, he or she slides the outer slide tube 11*c* on the stationary inner tube 11*b*, and prolongs and shrinks the vibrating column of air.

The supporting system 20 includes a manipulating board 20*a*, a driving mechanism 21 and a controlling unit 22. The driving mechanism 21 is provided in association with the slide 11*a*, and the manipulating board 20*a* and driving mechanism 21 are connected to the controlling unit 22. The manipulating board 20*a* is fitted to the slide receiver 17 so that a player makes known his or her intention to the controlling unit 22 through the manipulating board 20*a* during his or her performance.

The manipulating board 20*a* produces a control signal S1 representative of player's intention, and supplies the control signal S1 to the controlling unit 22. The controlling unit 22 determines how to assist the player in the performance on the basis of the control signal S1, and supplies a driving signal S2 to the driving mechanism 21. The driving mechanism 21 converts the driving signal S2 to force, and exerts the force on the slide 11*a*. The force gives rise to the linear movement of the outer slide tube 11*c* so that the slide 11*a* prolongs or shrinks the column of air.

Figure 2:
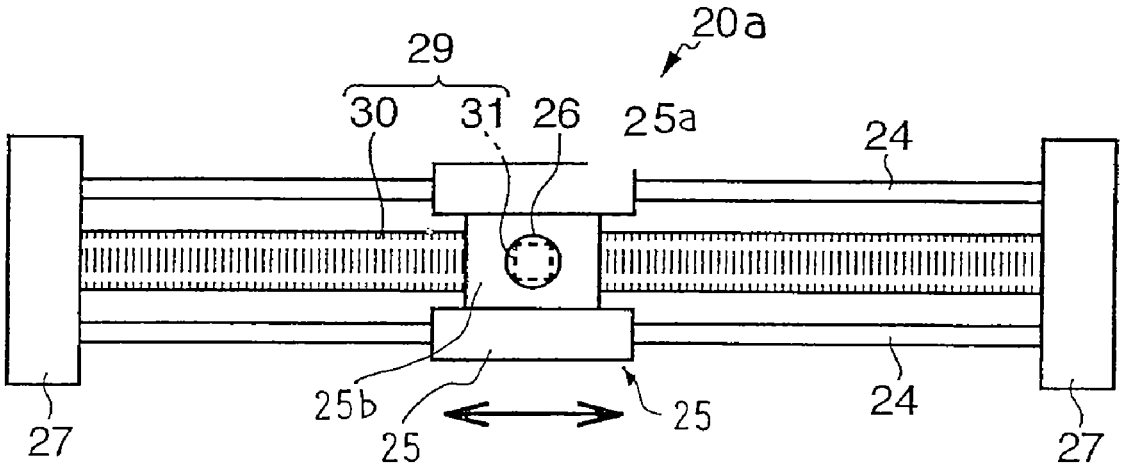
FIG. 2 is a front view showing a driving mechanism incorporated in the wind musical instrument.

Turning to FIG. 2, the driving mechanism 20*a* includes a pair of rails 24, a slider 25, a lever 26, a pair of side blocks 27 and a magnetic encoder 29. The side blocks 27 are fitted to the slide receiver 17, and are spaced from each other by distance equal to the length of the rails 24. The side blocks 27 may be adhered to the slide receiver 17. The pair of rails 24 is connected at both ends thereof to the side blocks 27, and the slider 25 is slidably supported by the pair of rails 24.

The slider 25 has a pair of sleeves 25*a* and a center plate 25*b*. The rails 24 are respectively inserted into the sleeves 25*a* so that the sleeves 25*a* are slidable on the associated rails 24. The center plate 25*b* is provided between the sleeves 25*a*, and makes both of the sleeves 25*a* slide together on the rails 24. The lever 26 projects from one of the side surfaces in the sideward direction, and a player exerts force on the lever 26 with his or her thumb or finger. Since the pair of rails 24 extends in parallel to the direction in which the outer slide tube 11*c* is moved, the slider 25 is also moved in parallel to the direction depending upon the direction in which the force is exerted on the lever 26. In this instance, the rails 24 are shorter than the full stroke of the outer slide tube 11*c* on the inner tube 11*b*. This feature is desirable for children or a player with a short reach, because they can fully move the slider 25 between the side blocks 27.

Figure 3:
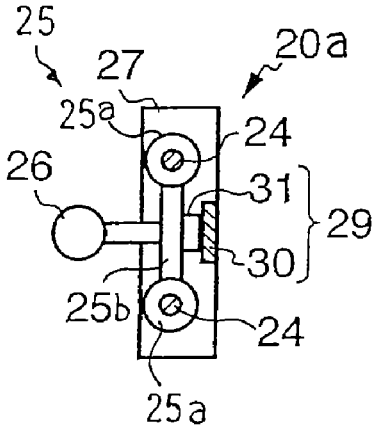
FIG. 3 is a side view showing the driving mechanism.

The magnetic encoder 29 has a magnetic scale 30 and a magnetic head 31. The magnetic scale 30 extends between the side blocks 27 in parallel to the pair of rails 24. The magnetic head 31 is fitted to the other side surface of the center plate 25*b* as shown in FIG. 3, and is faced to the magnetic scale 30 so as to convert the magnetic data on the magnetic scale 30 to the detecting signal S1. In this instance, the magnetic head 3 1 produces a pulse train representative of the magnetic data, and supplies the pulse train to the controlling unit 22 as the detecting signal S1.

Turning back to FIG. 1 of the drawings, the driving mechanism 21 includes a beam 33, an actuator 34, a converter 35 and a reaction canceller 38. In this instance, an ultrasonic motor serves as the actuator 34. The beam 33, ultrasonic motor 34 and converter 35 generate force for a movement of the slide 11, and the reaction canceller 38 cancels the reaction exerted on the remaining pipe structure. The ultrasonic motor 34 has an output shaft rotatably supported by a casing.

The beam 33 is connected at one end portion thereof to the tuning slide 13, and the ultrasonic motor 34 is fitted to the other end portion of the beam 33. The rack 36 is secured to the outer slide tube 11*c* so that the outer slide tube 11*c* is moved together with the rack 36. The pinion 35*a* is fixed to the output shaft of the ultrasonic motor 34 which extends in normal to a sheet of paper where FIG. 1 is drawn, and is held in meshing engagement with the rack 36. The driving signal S2 is supplied from the controlling unit 22 to the ultrasonic motor 34.

The ultrasonic motor 34 drives the output shaft for ration in the clockwise direction and counter clockwise direction in FIG. 1 in the presence of the driving signal S2 so that the pinion 35*a* rotates in the direction same as the rotating direction of the output shaft. When the electric power is removed from the ultrasonic motor 34, the output shaft is prevented from further rotation. While the ultrasonic motor 34 is rotating the pinion 35*a* in the counter clockwise direction, the rack 36 is moved in the rightward direction in FIG. 1, and, accordingly, the outer slide tube 11*c* projects from the inner tube 11*b*. On the other hand, while the ultrasonic motor 34 is rotating the pinion 35*a* in the clockwise direction, the rack 36 is moved in the leftward direction in FIG. 1, and, accordingly, the outer slide 11*c* makes the column of air shorter. Thus, the converter 35, i.e., the pinion 35*a* and rack 36 convert the rotation of output shaft to the bidirectional linear movements of the outer slide tube 11*c*.

While the ultrasonic motor 34 and converter 35 is exerting the force on the outer slide tube 11*c* without the reaction canceller 38, the reaction is transmitted from the ultrasonic motor 34 through the beam 33, tuning slide 13, slide receiver 17, mouthpiece receiver 18 and mouthpiece 15 to the lips of the player. In order to cancel the reaction, the reaction canceller 38 is provided on the beam 33 so that the reaction does not reach the tuning slide 13.

The reaction canceller 38 includes a slider 39, weight members 40, a bracket 41 and a counterforce generator 42. The bracket 41 is secured to the beam 33. The slider 39 extends in a direction parallel to the beam 33, and weight members 40 are secured to both end portions of the slider 39. The slider 39 is slidably supported by the bracket 41 in such a manner as to slide on the bracket 41 in the direction parallel to the beam 33. The counterforce generator 42 is fitted to the bracket 41, and is connected to the slider 39 in such a manner as to drive the slider 39 to slide in the direction opposite to the direction in which the outer slide tube 11*c* is moving. Since the both of the ultrasonic motors 34 and the counterforce generator 42 are supported by the beam 33, the reaction of the rotation of ultrasonic motor 34 is canceled with the reaction of the rotation of counterforce generator 42.

In this instance, the counterforce generator 42 is implemented by a combination of an ultrasonic motor 42A, a pinion 42B and a rack 42C. The ultrasonic motor 42A is secured to the bracket 41, and has an output shaft. The ultrasonic motor 42A is of the type preventing the output shaft from rotation in the absence of electric power. A driving signal S3 is supplied from the controlling unit 22 to the ultrasonic motor 42A, and the ultrasonic motor 42A bi-directionally rotates the output shaft with the driving signal S3. The pinion 42B is fitted to the output shaft so that the ultrasonic motor 42A rotates the pinion 42B by means of the rack 42C. The rack 42C is secured to the slider 39, and the pinion 42B is held in threaded engagement with the rack 42C. For this reason, the ultrasonic motor 42A gives rise to the sliding movements of the slider 39 with the driving signal S3, and generates the counterforce against the reaction due to the sliding movements of the outer slide tube 11*c*.

The controlling unit 22 is fitted to the pipe structure 11 by means of a suitable coupling device. The controlling unit 22 includes a signal input circuit 22A, a power source and current driver 22B and an information processor 22C. The signal input circuit 22A has a waveform shaping circuit and a buffer circuit. The pulse train, i.e., detecting signal S1 is shaped through the waveform shaping, and is, thereafter, stored in the buffer circuit. The signal input circuit 22A is connected to the information processor 22C.

The information processor 22C periodically fetches the detecting signal S1 from the buffer circuit, and examines to see whether or not the relative position between the magnetic scale 30 and the magnetic head 31 is varied. While the answer is being given negative, the driving signals S2 and S3 are not supplied to the ultrasonic motors 34 and 42A, and the outer slide tube 11*c* and slider 39 keep themselves at the present positions. On the other hand, when the answer is given affirmative, the information processor 22C calculates the revolutions of the output shafts of the ultrasonic motors 34 and 42A.

As described hereinbefore, the full stroke of outer slide tube 11*c* is longer than the movable range of the slider 25. When the information processor 22C determines the distance L over which the slider 25 is moved, the information processor 22C calculates the stroke S of the outer slide tube 11*c* by multiplying the distance L a constant $\alpha$. Subsequently, the information processor 22C determines the number of revolutions of the output shaft of the ultrasonic motor 34. The dimensions of pinions 35 are known, and the distance over which the rack 36 is to be moved is stored in the information processor 22C as a unit length. The information processor 22C divides the stroke S by the unit length. Thus, the information processor 22C calculates the number of revolutions of the output shaft of ultrasonic motor 34.

The information processor 22C further calculates velocity of the slider 39. As described hereinbefore, the slider 39 is to be moved in the direction opposite to the outer slide tune 11*c*. In order to cancel the reaction, the slider is to be moved at a target value of velocity V1 given as follows.

$$V1 = V2 \times M2/M1 \qquad \text{Equation 1}$$

where V2 is the velocity of the outer slide tube 11*c*, M2 is the total weight of the outer slide tube 11*c* and rack 36 and M1 is the total weight of the slider 39, pieces of weight 40 and rack 42C. The velocity V2 is determined on the basis of the number of revolutions of pinion 35 per second. While the slider 39 and pieces of weight 40 are moved on the bracket 41 at the velocity V1, the reaction exerted on the beam 33 becomes equal to the reaction exerted on the beam due to the rotation of the output shaft of ultrasonic motor 34 so that the reactions are canceled with one another. As a result, the player does not feel any reaction on his or her lips. Thus, the counterforce generator 38 makes the player feel the wind musical instrument same as the tenor trombone.

The information processor 22C is connected to the power source and driving circuit 22B. In this instance, the power source is implemented by a rechargeable battery, and the driving circuit produces the driving signals S2 and S3 under the control of the information processor 22C.

Assuming now a player wishes to perform a music tune with the assistance of the supporting system 20, he or she puts his or her lips on the mouthpiece 15, and controls the breach. The lips give rise to the vibrations of the column of air in the pipe structure 11. Then, the tone is radiated from the tenor trombone 10. The player controls his or her breath, and changes the slide 11 from one position to another position so as to change the pitch of tones.

The player is assumed to wish to prolong the column of air. He or she pushes the lever 26 in the rightward direction in FIG. 1 so that the slider 25 is spaced from the slide receiver 17. The magnetic head 31 is moved together with the slider 25 so that the magnetic scale 30 and magnetic head 31 change the relative position therebetween. The detecting signal S1 is supplied from the magnetic encoder 29 to the signal input circuit 22A.

The information processor 22C fetches the detecting signal from the signal input circuit 22A, and determines the number of revolutions of the output shaft of ultrasonic motor 34 and the revolutions per second for the ultrasonic motor 42A which corresponding to the velocity V1. The information processor 22C supplies control signals to the power source and current driver 22B, and causes the driving signals S2 and S3 to reach the ultrasonic motors 34 and 42A, respectively.

The driving signal S2 causes the ultrasonic motor 34 to be driven for rotation in the counter clockwise direction in FIG. 1, and the pinion 35*a* moves the rack 36 in the rightward direction together with the outer slide tube 11*c*. As a result, the column of air is prolonged, and the pitch of tone is sharped. Since the counterforce generator 38 exerts the force on the beam 33 against the reaction due to the rotation of the output shaft of ultrasonic motor 34, the supporting system 20 does not have any influence on player's lips.

On the other hand, when the player wishes to shorten the column of air, he or she pulls the lever 26 so that the slider 25 gets closer to the slide receiver 17. The magnetic encoder 29 supplies the detecting signal S1 to the signal input circuit 22A, and the information processor 22C determines the number of revolutions of the output shaft of ultrasonic motor 34 and the number of revolutions per second, and supplies the control signals to the power source and current driver 22B. The ultrasonic motor 34 rotates the output shaft and, accordingly, the pinion 35*a* in the clockwise direction so that the rack 36 is moved in the leftward direction together with the outer slide tube 11*c*. The counterforce generator 38 cancels the reaction due to the rotation of the output shaft of ultrasonic motor 34.

The slide 11*a* makes the column of air short so that the pitch of tone or tones is lowered. The player does not feel the reaction by virtue of the counterforce generator 38.

When a player wishes to perform a music tune without any assistance of the supporting system 20, any electronic power is not supplied to the controlling unit 22, and the player changes the pitch of tones through the control of breath and change of slide position by hand.

As will be understood from the foregoing description, the supporting system 20 assists the player in changing the slide 11*a* from one position to another position. Although the slide 11*a* is not so easy to be moved quickly by children, handicapped persons and old persons, the supporting system 20 makes it possible to move the outer slide tube 11*c* as quick as adult players. Thus, the supporting system 20 widens the repertory of music for the children, handicapped persons and old persons.

The player may slide the lever 26 without any exertion of his or her force on the outer slide tube 11*c*. In this situation, only the driving mechanism 21 gives rise to the sliding of the outer slide tube 11*c*, and the player controls the lever 26 and his or her breath. On the other hand, a player may exerts the force on both of the lever 26 and the outer slide tube 11*c*. In this situation, the driving mechanism 21 makes the load on this thumb and finger light.

Even if a player has a short reach, the slider 25 is moved in the range narrower than the stroke of outer slide tube 11*c* so that the player can change the slide 1*a* among all the slide positions.

In case where the beam 33, pinions 35*a*/42B and racks 36/42C are made of synthetic resin, the supporting system 20 is not so heavy that the player can perform music tunes on the wind musical instrument as similar to on a standard trombone.

Second Embodiment

Figure 4:
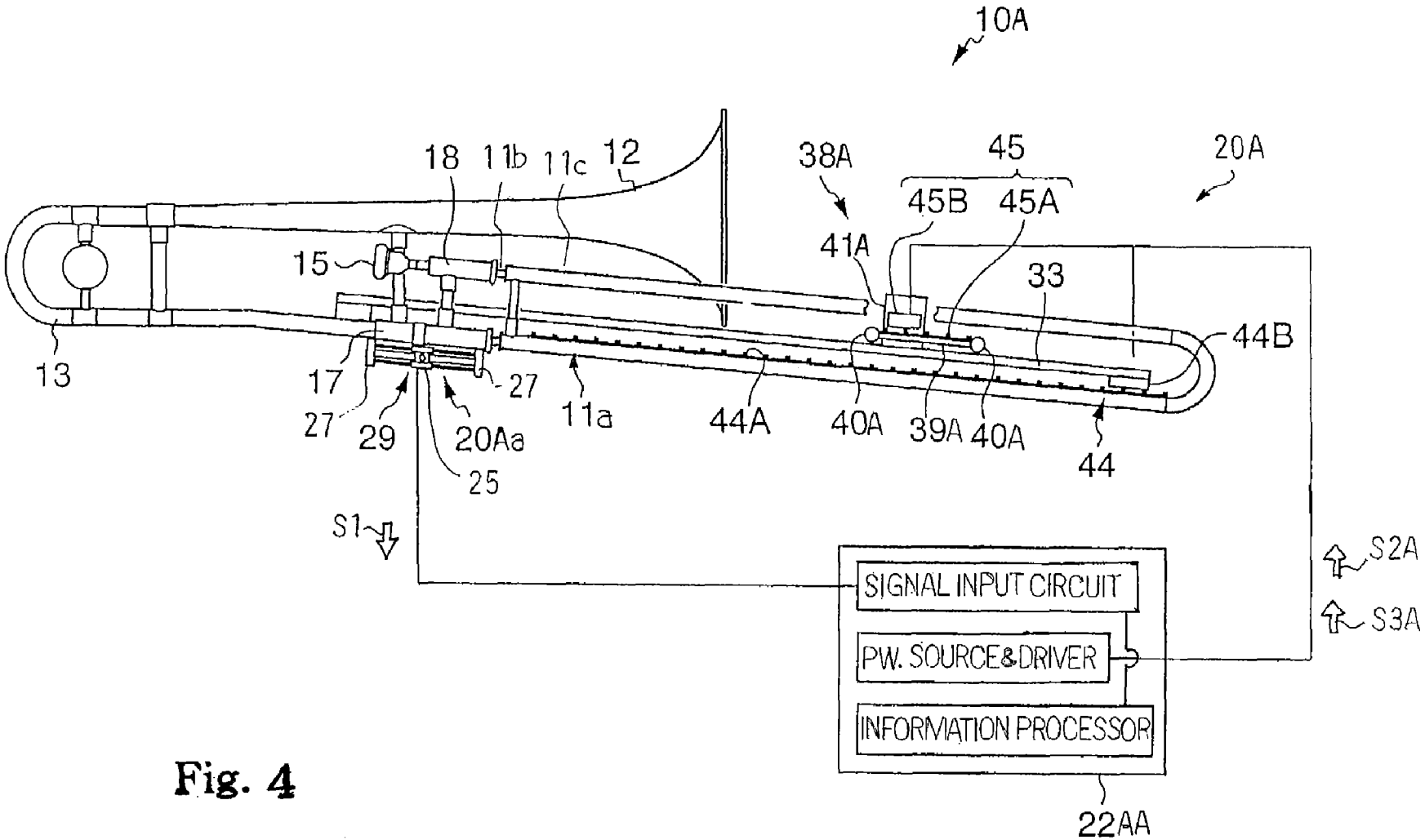
FIG. 4 is a partially cut-off schematic view showing the structure of another wind musical instrument according to the present invention.

Turning to FIG. 4 of the drawings, another wind musical instrument embodying the present invention largely comprises a tenor trombone 10A and a supporting system 20A. The tenor trombone 10A is similar in structure to the tenor trombone 10, and, for this reason, component parts of the tenor trombone 10A are labeled with references designating the corresponding component parts of the tenor trombone 10 without detailed description.

The supporting system 20A includes a manipulating board 20Aa, a driving mechanism 44 and a controlling unit 22AA. The manipulating board 20Aa and controlling unit 22AA are similar to the manipulating board 20*a* and controlling unit 22, and detailed description is omitted for avoiding repetition. For this reason, description is focused on the driving mechanism 44.

The driving mechanism 44 includes a beam 33, an actuator 45, a converter 44B and a reaction canceller 38A. In this instance, a surface acoustic wave motor 44B serves as the actuator 45. While the controlling unit 22AA is energizing the surface acoustic wave motor 44B with a driving signal S2A, surface acoustic waves are generated, and are propagated on the surface of the surface acoustic wave motor 44B. The beam 33, surface acoustic motor 44B and converter 44A generate force for a movement of the slide 11, and the reaction canceller 38A cancels the reaction exerted on the remaining pipe structure.

The beam 33 is connected at one end portion thereof to the tuning slide 13, and the surface acoustic wave motor 44B is fitted to the other end portion of the beam 33. The converter 44A is implemented by a movable body, and the movable body 44A converts the surface acoustic wave to a movement of the outer slide tube 11*c*. The movable body 44A extends on the outer slide tube 11*c*, and is secured to the surface of the outer slide tube 11*c*. While the surface acoustic wave motor 44B is generating the surface acoustic wave, the movable body 44A is moved due to the friction, and the outer slide tube 11*c* is also moved on the inner tube 11*b*.

The counterforce generator 38A includes a slider 39A, pieces of weight 40A, a bracket 41A and a counter force generator 45. The slider 39A, pieces of weight 40A and bracket 41A are similar to the slider 39, pieces of weight 40 and bracket 41, and, for this reason, no further description is hereinafter incorporated. In this instance, the counterforce generator 45 is implemented by a combination of a movable body 45A and a surface acoustic wave motor 45B. The surface acoustic wave motor 45B is responsive to a driving signal S3A so as to give rise to counterforce against the reaction as similar to the counterforce generator 38.

The supporting system 20A behaves as similar to the supporting system 20 so as to assist a player in his or her performance on the tenor trombone.

Third Embodiment

Figure 5:
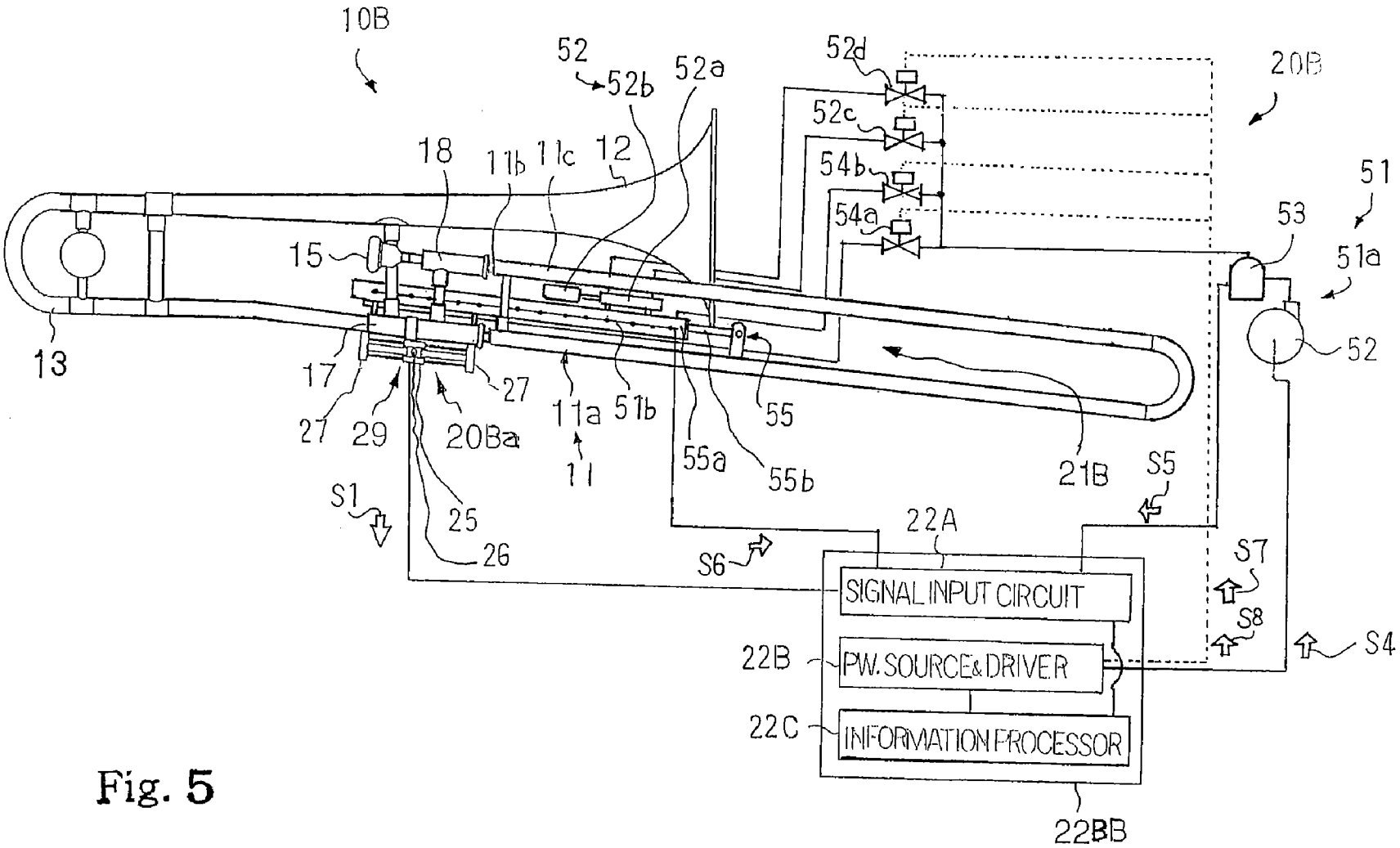
FIG. 5 is a schematic view showing the structure of yet another wind musical instrument according to the present invention.

Turning to FIG. 5 of the drawings, yet another wind musical instrument embodying the present invention largely comprises a tenor trombone 10B and a supporting system 20BB. The tenor trombone 10B is similar in structure to the tenor trombone 10, and, for this reason, component parts of the tenor trombone 10B are labeled with references designating the corresponding component parts of the tenor trombone 10 without detailed description.

The supporting system 20BB includes a manipulating board 20Ba, a driving mechanism 21B and a controlling unit 22B. The manipulating board 20Ba is similar to the manipulating board 20*a*, and detailed description on the manipulating board 20Ba is omitted for avoiding repetition. Although the controlling unit 22BB also includes the signal input circuit 22A, power source and current driving circuit 22B and information processor 22C, a different computer program is loaded into the information processor 22C, and is hereinafter described together with the driving mechanism 21B.

The driving mechanism 44 includes a beam 33, an actuator 51 and a reaction canceller 52. In this instance, a combination of a pneumatic system 51*a* and a plunger sensor 51*b* serves as the actuator 51. However, any converter is not incorporated in the driving mechanism 21B. This is because of the fact that the pneumatic system 51*a* produces force in the direction in parallel to the sliding direction of outer slide tube 11*c*.

The pneumatic system 51*a* includes a combined unit 52 of an air pump and an electric motor, a reservoir 53, tri-state electromagnetic valves 54*a*/54*b* and a pneumatic actuator 55. The pneumatic actuator 55 has a cylinder 55*a* supported by the slide receiver 17, and a plunger 55*b* connected to the outer slide tube 11*c*. The cylinder 55*a* has a centerline extending in parallel to the sliding direction of the outer slide tube 11*c*, and the plunger 55*b* is projectable from and retractable into the cylinder 55*a*. Thus, the pneumatic actuator 55 generates the force in the direction parallel to the sliding direction.

The combined unit 52 is powered with a driving signal S4, and generates high-pressure air. The air pump of the combined unit 52 is connected to the reservoir 53, and the high-pressure air is accumulated in the reservoir 53. Though not shown in FIG. 5, a pressure switch is provided in the reservoir 53, and a pressure signal S5 is supplied from the pressure switch to the signal input circuit 22A. The information processor 22C periodically checks the pressure signal S5 to see whether or not the air pressure is maintained in a certain range. When the air pressure is lowered below the lower limit, the information processor 22C causes the power source and current driver 22B to supply the driving signal S4 so as to actuate the combined unit 52. When the air pressure reaches the upper limit, the information processor 22C causes the power source and current driver 22B to stop the driving signal S4. Thus, the combined unit 52 and controller 22BB keep the air pressure in the certain range.

The three-state electromagnetic valves 54*a* and 54*b* are connected in parallel between the reservoir 53 and two chambers in the cylinder 55*a*, and control signals lines are connected between the power source and current driver 22B and the three-state electromagnetic valves 54*a* and 54*b*. Control signals S7 are supplied from the controlling unit 22BB to the three-state electromagnetic valves 54*a* and 54*b*. While the three-state electromagnetic valves 54*a* and 54*b* are staying in high-impedance state, the high-pressure air is confined in both chambers of the cylinder 55*a*, and the pneumatic actuator 55 does not permit the outer slide tube 11*c* to change the slide position. When the three-state electromagnetic valve 54*a* connects the reservoir 53 to the rear chamber, the other three-state electromagnetic valve 54*b* connects the front chamber to the atmosphere, and the high-pressure air causes the plunger 55*b* to project from the cylinder 55*a*. Since the plunger 55*b* is connected to the outer slide tube 11*c*, the outer slide tube 11*c* is moved on the inner tube 11*b* in the rightward direction in FIG. 5. On the other hand, when the three-state electromagnetic valve 54*b* connects the reservoir 53 to the front chamber, the other three-state electromagnetic valve 54*a* connects the rear chamber to the atmosphere, and the high-pressure air causes the plunger 55*b* to be retracted into the cylinder 55*a*. Then, the outer slide tube 11*c* is moved on the inner tube 11*b* in the leftward direction in FIG. 5.

The plunger 55*b* is monitored with the plunger sensor 51*b*, and a plunger position signal S6 is supplied from the plunger sensor 51*b* to the signal input circuit 22A. The information processor 22C periodically checks the plunger position signal S6 to see whether or not the plunger has already traveled over a target stroke, which is $\beta$ times greater than the stroke S of the lever 26. The constant $\beta$ is greater than 1. When the plunger 55*b* reaches the target position, the information processor 22C causes the power source and current driver 22B to change both of the three-state electromagnetic valves 54*a* and 54*b* to the high-impedance state. Thus, the player changes the outer slide tube 11*c* from a slide position to another slide position with the assistance of the driving mechanism 21B.

The reaction canceller 52 includes a pneumatic actuator 52*a*, a piece of weight 52*b* and three-state electromagnetic valves 52*c* and 52*d*. The three-state electromagnetic valves 52*c* and 52*d* are responsive to control signals S8 so as to connect the reservoir 53 to the pneumatic actuator 52*a*. The cylinder of the pneumatic actuator 52*a* is supported by the cylinder 55*a*, and the piece of weight 52*b* is fitted to the leading end of the plunger of the pneumatic actuator 52*a*. Since the pneumatic actuator 52*a* causes the plunger thereof in the direction opposite to the direction in which the pneumatic actuator 55 causes the plunger 55*b* to project. The mass of the piece of weight 52*b* is determined in such a manner that the reaction canceller 52 cancels the reaction of the sliding motion of the outer slide tube 11*c*. As a result, the player can perform a music passage on the wind musical instrument without uncomfortable feeling.

Although particular embodiments of the present invention have been shown and described, it will be apparent to those skilled in the art that various changes and modifications may be made without departing from the spirit and scope of the present invention.

The controlling unit 22 may be separated from the trombone 10. In this instance, the magnetic encoder 29 and ultrasonic motors 34 and 42A are connected to the controlling unit 22 through cables.

The power source may be implemented by a transformer connected through a cable to a receptacle.

The tenor trombone does not set any limit to the technical scope of the present invention. The supporting system may be combined with another sort of wind musical instrument such as, for example, an alto trombone, a bass trombone and a double bass trombone. The present invention may appertain to another wind musical instrument such as, for example, a slide trumpet.

The magnetic encoder may be replaced with an optical encoder, and the ultrasonic motor may be replaced with a direct-current motor. A suitable breaking mechanism may be prepared in the direct-current motor, or electric power is continuously supplied to the direct-current motor.

The manipulating board 20*a* may be fitted to any part of the pipe structure in so far as a player can move the lever over the full stroke.

The reaction canceller is not an indispensable element of the driving system. In case where, the reaction is ignoreable, the reaction canceller may be deleted from the driving system.

The slidable lever 26 does not set any limit to the technical scope of the present invention. A supporting mechanism of the present invention may have a rotary encoder so that a player rotates a knob of the rotary encoder for varying the length of the slide 11.

The supporting systems 20, 20A and 20B may be offered to users independently of the trombones. Users buy the supporting systems 20, 20A and 20B, and combine the supporting systems 20, 20A and 20B with their trombones so as to retrofit the trombones to the wind musical instruments according to the present invention.

The pneumatic system may be replaced with a hydraulic system. The pneumatic actuator or hydraulic actuator may telescopically project and retracted.

The component parts of the wind musical instrument embodying the present invention are correlated with claim languages as follows. The pipe structure 11 is corresponding to a "pipe structure", and the slide 11, i.e., the combination of inner tube 11*b* and outer slide tube 11*c* serves as a "slide". Each of the supporting systems 20, 20A and 20B is corresponding to a "supporting system", and each of the manipulating boards 20*a*, 20Aa and 20Ba serves as a "manipulating board". The pair of rails 24, slider 25 and lever 26 as a whole constitute a "manipulator". The magnetic encoder 29 or plunger sensor 51*b* serves as a "signal generator". Each of the driving mechanisms 21, 44 and 21B is corresponding to a "driving mechanism", and each of the controlling units 22, 22AA and 22BB serves as a "controller".

The beam 33 and casing of the ultrasonic motor 34 as a whole constitute a "stationary portion of actuator", and the output shaft of the ultrasonic motor 34 is corresponding to a "movable portion". The rotation or vibrations are a "certain sort of motion", and the linear movement belongs to "another sort of motion". The pinion and rack 35*a*/36 or movable body 44A serves as a "converter".

What is claimed is:

1. A wind musical instrument for producing tones through breath of a human player, comprising:

a pipe structure defining a column of air therein, permitting said human player to excite the column of air for vibrations, and including a slide varying the length of said column of air through elongation and shrinkage thereof for changing the pitch of said tones; and a supporting system assisting said human player in changing said pitch of said tones, and including a manipulating board having a manipulator moved by said human player so as to indicate a target length of said column of air and a signal generator producing a detecting signal representative of said target length, a driving mechanism connected to said slide and responsive to a driving signal so as to elongate and shrink said slide, and a controller connected to said signal generator and said driving mechanism and supplying said driving signal to said driving mechanism so as to elongate and shrink said slide until said column of air becomes said target length.

2. The wind musical instrument as set forth in claim 1, in which said slide has an inner tube connected to a remaining portion of said pipe structure and an outer slide tube telescopically combined with said inner tube so that said slide is elongated and shrunk through a sliding movement of said outer slide tube on said inner tube.

3. The wind musical instrument as set forth in claim 2, in which said driving mechanism includes an actuator having a stationary portion stationary with respect to said inner tube and a movable portion connected to said outer slide tube so as to give rise to said sliding movement.

4. The wind musical instrument as set forth in claim 3, in which said stationary portion gives rise to a certain sort of movement of said movable portion different from said sliding movement of said slide, wherein said driving mechanism further includes a converter provided between said movable portion and said slide so as to convert said certain sort of movement to said sliding movement.

5. The wind musical instrument as set forth in claim 4, in which said certain sort of movement is revolutions.

6. The wind musical instrument as set forth in claim 4, in which said certain sort of movement is vibrations.

7. The wind musical instrument as set forth in claim 3, in which said driving mechanism further includes a reaction canceller canceling a reaction due to an actuation of said actuator so as to prevent said human player from said reaction.

8. The wind musical instrument as set forth in claim 7, in which said driving mechanism further includes a converter provided between said movable portion and said slide so as to convert a certain sort of movement of said movable portion to said sliding movement of said slide, wherein said reaction canceller gives rise to another sliding movement opposite in direction to said sliding movement of said slide.

9. The wind musical instrument as set forth in claim 1, in which said human player gives rise to a certain sort of motion of said manipulator, and said slide elongates and shrinks said column of air through said certain sort of motion thereof.

10. The wind musical instrument as set forth in claim 9, in which said certain sort of motion is a sliding movement.

11. The wind musical instrument as set forth in claim 9, in which a full stroke of said manipulator is shorter than a full stroke of said slide so that said controller calculates a target stroke of said slide on the basis of an actual stroke of said manipulator.

12. The wind musical instrument as set forth in claim 1, in which said pipe structure further includes a mouthpiece on which said human player buzzes, a bell flared toward the outside of said pipe structure, and other pipes connected between said mouthpiece and said slide and between said slide and said bell.

13. The wind musical instrument as set forth in claim 12, in which said mouthpiece, said bell, said slide and said other pipes form in combination a trombone.

14. A supporting system combined with a wind instrument equipped with a slide for changing the pitch of tones produced through said wind instrument, comprising:

a manipulating board including a manipulator moved by said human player so as to indicate a target length of a column of air created in said wind instrument and a signal generator producing a detecting signal representative of said target length;

a driving mechanism connected to said slide, and responsive to a driving signal so as to elongate and shrink said slide; and a controller connected to said signal generator and said driving mechanism and supplying said driving signal to said driving mechanism so as to elongate and shrink said slide until said column of air becomes said target length.

15. The supporting system as set forth in claim 14, in which said slide has an inner tube connected to a remaining portion of said pipe structure and an outer slide tube telescopically combined with said inner tube so that said slide is elongated and shrunk through a sliding movement of said outer slide tube on said inner tube.

16. The supporting system as set forth in claim 15, in which said driving mechanism includes an actuator having a stationary portion stationary with respect to said inner tube and a movable portion connected to said outer slide tube so as to give rise to said sliding movement.

17. The wind musical instrument as set forth in claim 16, in which said stationary portion gives rise to a certain sort of movement of said movable portion different from said sliding movement of said slide, wherein said driving mechanism further includes a converter provided between said movable portion and said slide so as to convert said certain sort of movement to said sliding movement.

18. The supporting system as set forth in claim 17, in which said driving mechanism further includes a reaction canceller canceling a reaction due to an actuation of said actuator so as to prevent said human player from said reaction.

19. The supporting system as set forth in claim 14, in which said human player gives rise to a certain sort of motion of said manipulator, and said slide elongates and shrinks said column of air through said certain sort of motion thereof.

20. The supporting system as set forth in claim 19, in which a full stroke of said manipulator is shorter than a full stroke of said slide so that said controller calculates a target stroke of said slide on the basis of an actual stroke of said manipulator.

* * * * *